US007316632B2

(12) United States Patent
Rodgers, Jr.

(10) Patent No.: US 7,316,632 B2
(45) **Date of Patent: *Jan. 8, 2008**

(54) VARIABLE STRIDE EXERCISE APPARATUS

(76) Inventor: Robert E. Rodgers, Jr., 974 Kings Point Dr., Canyon Lake, TX (US) 78133

( * ) Notice: Subject to any disclaimer, the term of this patent is extended or adjusted under 35 U.S.C. 154(b) by 400 days.

This patent is subject to a terminal disclaimer.

(21) Appl. No.: 10/862,676

(22) Filed: Jun. 7, 2004

(65) Prior Publication Data

US 2004/0248709 A1 Dec. 9, 2004

Related U.S. Application Data

(63) Continuation-in-part of application No. 10/723,734, filed on Nov. 26, 2003, now Pat. No. 7,172,531.

(60) Provisional application No. 60/476,548, filed on Jun. 6, 2003, provisional application No. 60/486,333, filed on Jul. 11, 2003, provisional application No. 60/490,154, filed on Jul. 25, 2003, provisional application No. 60/491,382, filed on Jul. 31, 2003, provisional application No. 60/494,308, filed on Aug. 11, 2003, provisional application No. 60/503,905, filed on Sep. 19, 2003, provisional application No. 60/511,190, filed on Oct. 14, 2003, provisional application No. 60/515,238, filed on Oct. 29, 2003.

(51) Int. Cl.
*A63B 22/00* (2006.01)
*A63B 22/06* (2006.01)

(52) U.S. Cl. ..... 482/52; 482/57

(58) Field of Classification Search ..... 482/51, 482/52, 57, 70

See application file for complete search history.

(56) References Cited

U.S. PATENT DOCUMENTS 1,166,304 A 12/1915 Albert
3,316,899 A 5/1967 Raeder (Continued)

FOREIGN PATENT DOCUMENTS

EP 914842 5/1999

(Continued)

OTHER PUBLICATIONS

U.S Appl. No. 10/875,049, filed Jun. 2004, Lull et al.*

(Continued)

*Primary Examiner*—Stephen R. Crow
(74) *Attorney, Agent, or Firm*—Fulbright & Jaworski LLP

(57) ABSTRACT

A variable stride exercise apparatus is described. The apparatus may include a frame. A crank system may be coupled to the frame. The crank system may include crank rollers. In certain embodiments, arm links may be coupled to the frame. The apparatus may include foot members that travel in multiple paths. The foot members may be coupled to the arm links. The foot members may be coupled to the crank system through cam devices. The crank rollers may be located below the foot members such that at least a portion of a user's foot passes above the crank roller during use of the apparatus. A user of the apparatus, by varying the user's stride, may selectively vary a path of the foot members. The foot members may be cross coupled so that the left foot member moves in opposition to the right foot member.

21 Claims, 4 Drawing Sheets

U.S. PATENT DOCUMENTS

| | | | |
|---|---|---|---|
| 3,578,800 | A | 5/1971 | DiNepi |
| 3,741,538 | A | 6/1973 | Lewis et al. |
| 4,632,385 | A | 12/1986 | Geraci |
| 4,684,121 | A | 8/1987 | Nestegard |
| 5,000,443 | A | 3/1991 | Dalebout et al. |
| 5,078,389 | A | 1/1992 | Chen |
| 5,094,449 | A | 3/1992 | Stearns |
| 5,094,450 | A | 3/1992 | Stearns |
| 5,203,826 | A | 4/1993 | Dalebout |
| 5,247,853 | A | 9/1993 | Dalebout |
| 5,290,205 | A | 3/1994 | Densmore et al. |
| 5,290,211 | A | 3/1994 | Stearns |
| 5,299,993 | A | 4/1994 | Habing |
| 5,336,146 | A | 8/1994 | Piaget et al. |
| 5,346,447 | A | 9/1994 | Stearns |
| 5,401,226 | A | 3/1995 | Stearns |
| 5,489,250 | A | 2/1996 | Densmore et al. |
| 5,499,956 | A | 3/1996 | Habing et al. |
| 5,545,112 | A | 8/1996 | Densmore et al. |
| 5,616,103 | A | 4/1997 | Lee |
| 5,626,539 | A | 5/1997 | Piaget et al. |
| 5,658,223 | A | 8/1997 | Habing et al. |
| 5,669,856 | A | 9/1997 | Liu |
| 5,692,997 | A | 12/1997 | Stearns |
| 5,708,060 | A | 1/1998 | Sands et al. |
| 5,709,632 | A | 1/1998 | Socwell |
| 5,735,773 | A | 4/1998 | Vittone |
| 5,735,774 | A | 4/1998 | Maresh |
| 5,743,834 | A | 4/1998 | Rogers, Jr. |
| 5,759,135 | A | 6/1998 | Chen |
| 5,762,588 | A | 6/1998 | Chen |
| 5,769,760 | A | 6/1998 | Lin |
| 5,779,599 | A | 7/1998 | Chen |
| 5,792,027 | A | 8/1998 | Gvoich |
| 5,792,028 | A | 8/1998 | Jarvie |
| 5,795,268 | A | 8/1998 | Husted |
| 5,833,584 | A | 11/1998 | Piaget et al. |
| 5,865,712 | A | 2/1999 | Chang |
| 5,908,373 | A | 6/1999 | Pitre |
| 5,910,072 | A | 6/1999 | Rawls et al. |
| 5,916,065 | A | 6/1999 | McBride et al. |
| 5,919,118 | A | 7/1999 | Stearns et al. |
| 5,921,894 | A | 7/1999 | Eschenbach |
| 5,935,046 | A | 8/1999 | Maresh |
| 5,938,575 | A | 8/1999 | Stearns |
| 5,947,872 | A | 9/1999 | Ryan et al. |
| 5,957,814 | A | 9/1999 | Eschenbach |
| 5,964,682 | A | 10/1999 | Sokol |
| 5,967,944 | A | 10/1999 | Vittone et al. |
| 5,971,892 | A | 10/1999 | Lee |
| 5,993,359 | A | 11/1999 | Eschenbach |
| 5,997,445 | A | 12/1999 | Maresh et al. |
| 6,004,244 | A | 12/1999 | Simonson |
| 6,019,710 | A | 2/2000 | Dalebout |
| 6,027,430 | A | 2/2000 | Stearns et al. |
| 6,027,431 | A | 2/2000 | Stearns et al. |
| 6,036,622 | A | 3/2000 | Gordon |
| 6,053,847 | A | 4/2000 | Stearns et al. |
| 6,123,650 | A | 9/2000 | Birrell |
| 6,126,574 | A | 10/2000 | Stearns et al. |
| 6,152,859 | A | 11/2000 | Stearns |
| 6,165,107 | A | 12/2000 | Birrell |
| 6,183,397 | B1 | 2/2001 | Stearns et al. |
| 6,196,948 | B1 | 3/2001 | Stearns et al. |
| 6,206,804 | B1 | 3/2001 | Maresh |
| 6,217,485 | B1 | 4/2001 | Maresh |
| 6,248,044 | B1 | 6/2001 | Stearns et al. |
| 6,248,045 | B1 | 6/2001 | Stearns et al. |
| 6,338,698 | B1 | 1/2002 | Stearns et al. |
| 6,361,476 | B1 | 3/2002 | Eschenbach |
| 6,368,252 | B1 | 4/2002 | Stearns |
| 6,390,953 | B1 | 5/2002 | Maresh et al. |
| 6,416,442 | B1 | 7/2002 | Stearns |
| 6,436,007 | B1 | 8/2002 | Eschenbach |
| 6,440,042 | B2 | 8/2002 | Eschenbach |
| 6,500,098 | B1 | 12/2002 | Werner |
| 6,565,486 | B2 | 5/2003 | Stearns et al. |
| 6,612,969 | B2 | 9/2003 | Eschenbach |
| 6,626,802 | B1 | 9/2003 | Rodgers, Jr. |
| 6,629,909 | B1 | 10/2003 | Stearns et al. |
| 6,648,801 | B2 | 11/2003 | Stearns et al. |
| 6,689,019 | B2 * | 2/2004 | Ohrt et al. ..... 482/52 |
| 6,719,666 | B1 | 4/2004 | Lo et al. |
| 2001/0001305 | A1 | 5/2001 | Stearns et al. |
| 2001/0036886 | A1 | 11/2001 | Eschenbach |
| 2001/0051562 | A1 | 12/2001 | Stearns et al. |
| 2001/0056010 | A1 | 12/2001 | Stearns et al. |
| 2002/0019298 | A1 | 2/2002 | Eschenbach |
| 2002/0055420 | A1 | 5/2002 | Stearns et al. |
| 2002/0094914 | A1 | 7/2002 | Maresh et al. |
| 2002/0165066 | A1 | 11/2002 | Stearns et al. |
| 2002/0198084 | A1 | 12/2002 | Stearns et al. |
| 2004/0097339 | A1 | 5/2004 | Moon |
| 2005/0026752 | A1 | 2/2005 | Lull et al. |

FOREIGN PATENT DOCUMENTS

| | | |
|---|---|---|
| WO | 95/16502 | 6/1995 |

OTHER PUBLICATIONS

Inshape, "A fitness machine for all reasons", relating to Precor C544, 1 page, undated.

"New Cardio Machines: Good for the Heart and Mind", Noah Liberman, HG&F, relates to Precor C544 Transport, 1 page, undated.

Health and Fitness, "Get Elliptical", 1 page, undated, but before mid-1996.

Profiles in Quality, "Precor: Work Out Smarter", Club Industry, 1 page, approx. 1995.

Home Gym and Fitness, "Inside Sports", 1 page, Spring 1996.

Health & Fitness Business Buyer's Guide, "Commercial Market In Store for Surprise", 2 pages, Fall 1996.

Home Gym and Fitness, Inside Sports, "The New Cardio Machines" Easy on the Body, Good for the Heart, 2 pages, Winter 1996.

"Diet Wars The fads/the facts", SHAPE, 1 page, Feb. 1996.

Article from Delaware State News, "Newest fitness stuff goes on display", Marilynn Preston, 1 page, Jul. 31, 1996.

North Coast Sports, vol. 3, Issue 8, 1 page, Sep. 1996.

Sporting Goods, Machine Design, Oct. 10, 1996.

Men's Fitness, "It'a stairmill . . . It'a a treadclimber . . . It's a EFX", 2 pages, Nov. 1996.

Fitness Product News, "Zero Impact Exercise", 2 pages, Nov./Dec. 1996.

Article from Poughkeepsie Journal, "Fitness machine flurry can be confusing", Allision Simmons, 1 page, Jan. 16, 1997.

Health & Fitness, "Less Pain for the Gain", 1 page, Feb. 24, 1997.

"One mean machine" relating to Precor Elliptical trainers, SHAPE, 1 page, Mar. 1997.

Bacon's, "Spin to it!", "Fitness: New exercise machines that employ elliptical movements are a hot item at health clubs", 1 page, Jun. 4, 1997.

Time digital, "How best to break a High-Tech sweat?", relates to Precor EFX, 1 page, Jul./Aug. 1997.

Cincinnati Enquirer, "Elliptical cross-trainers, outspacing traditional climbers", Aug. 20, 1997.

The San Diego Union-Tribune, "New machines prove popular with gym rats", 1 page, Nov. 5, 1997.

Health & Fitness Business Buyer's Guide, Cardiovascular, "Changing of the Guard", 2 pages, Jun. 1999.

"Schwinn Fitness Harness the Force of Nature and You Possess the Strength of Confidence", Schwinn, Cycling & Fitness, Inc., catalog, 30 pages, 1996.

"Nautilus Home Health & Fitness Catalog", Nautilus, Inc. pp. 1-56 (2004).

Provisional Patent Application entitled "Variable Stride Exercise Device", Express Mail No. EV156971344US, 16 pages.

Provisional Patent Application entitled "Variable Stride Exercise Device" to Lull et al., Express Mail No. EV423770351US, 59 pages.

* cited by examiner

VARIABLE STRIDE EXERCISE APPARATUS

PRIORITY CLAIM

This application is a continuation-in-part of U.S. patent application Ser. No. 10/723,734 entitled "Variable Stride Exercise Apparatus" to Robert E. Rodgers, Jr., filed on Nov. 26, 2003 now U.S. Pat. No. 7,172,531, which claims the benefits of: U.S. Provisional Patent Application No. 60/476,548 entitled "Variable Stride Elliptic Exercise Device" to Robert E. Rodgers, Jr., filed on Jun. 6, 2003; U.S. Provisional Patent Application No. 60/486,333 entitled "Variable Stride Exercise Device" to Robert E. Rodgers, Jr., filed on Jul. 11, 2003; U.S. Provisional Patent Application No. 60/490,154 entitled "Variable Stride Exercise Device" to Robert E. Rodgers, Jr., filed on Jul. 25, 2003; U.S. Provisional Patent Application No. 60/491,382 entitled "Variable Stride Exercise Device" to Robert E. Rodgers, Jr., filed on Jul. 31, 2003; U.S. Provisional Patent Application No. 60/494,308 entitled "Variable Stride Exercise Device" to Robert E. Rodgers, Jr., filed on Aug. 11, 2003; U.S. Provisional Patent Application No. 60/503,905 entitled "Variable Stride Exercise Device" to Robert E. Rodgers, Jr., filed on Sep. 19, 2003; U.S. Provisional Patent Application No. 60/511,190 entitled "Variable Stride Apparatus" to Robert E. Rodgers, Jr., filed on Oct. 14, 2003; and U.S. Provisional Patent Application No. 60/515,238 entitled "Variable Stride Exercise Device" to Robert E. Rodgers, Jr., filed on Oct. 29, 2003.

BACKGROUND

1. Field of the Invention

The present invention relates generally to an exercise apparatus. Certain embodiments relate to variable motion exercise apparatus that may allow exercise such as simulated climbing, walking, striding, and/or jogging.

2. Description of Related Art

Exercise devices have been in use for years. Some typical exercise devices that simulate walking or jogging include cross country ski machines, elliptical motion machines, and pendulum motion machines.

Elliptical motion exercise apparatus in many cases provide inertia that assists in direction change of the pedals, making the exercise smooth and comfortable (e.g., see U.S. Pat. Nos. 5,242,343 to Miller; 5,383,829 to Miller; 5,518,473 to Miller; 5,755,642 to Miller; 5,577,985 to Miller; 5,611,756 to Miller; 5,911,649 to Miller; 6,045,487 to Miller; 6,398,695 to Miller; 5,913,751 to Eschenbach; 5,916,064 to Eschenbach; 5,921,894 to Eschenbach; 5,993,359 to Eschenbach; 6,024,676 to Eschenbach; 6,042,512 to Eschenbach; 6,045,488 to Eschenbach; 6,077,196 to Eschenbach; 6,077,198 to Eschenbach; 6,090,013 to Eschenbach; 6,090,014 to Eschenbach; 6,142,915 to Eschenbach; 6,168,552 to Eschenbach; 6,210,305 to Eschenbach; 6,361,476 to Eschenbach; 6,409,632 to Eschenbach; 6,422,976 to Eschenbach; 6,422,977 to Eschenbach; 6,436,007 to Eschenbach; 6,440,042 to Eschenbach; 6,482,132 to Eschenbach; and 6,612,969 to Eschenbach).

Elliptical motion exercise apparatus are also described in U.S. Pat. Nos. 5,573,480 to Rodgers, Jr.; 5,683,333 to Rodgers, Jr.; 5,738,614 to Rodgers, Jr.; 5,924,962 to Rodgers, Jr.; 5,938,567 to Rodgers, Jr.; 5,549,526 to Rodgers, Jr.; 5,593,371 to Rodgers, Jr.; 5,595,553 to Rodgers, Jr.; 5,637,058 to Rodgers, Jr.; 5,772,558 to Rodgers, Jr.; 5,540,637 to Rodgers, Jr.; 5,593,372 to Rodgers, Jr.; 5,766,113 to Rodgers, Jr.; 5,813,949 to Rodgers, Jr.; 5,690,589 to Rodgers, Jr.; 5,743,834 to Rodgers, Jr.; 5,611,758 to Rodgers, Jr.; 5,653,662 to Rodgers, Jr.; and 5,989,163 to Rodgers, Jr., each of which is incorporated by reference as if fully set forth herein.

In many exercise apparatus, rigid coupling to a crank generally confines the elliptical path to a fixed stride or path length. The fixed elliptical path length may either be too long for shorter users or too short for taller users.

Adjustable stride elliptical exercise apparatus have been disclosed in previous patents (e.g., U.S. Pat. No. 5,743,834 to Rodgers, Jr.). Although some of these exercise apparatus have addressed the issue of a fixed path length, the stride adjustment is made through changes or adjustments to the crank geometry. Mechanisms for adjustment in such apparatus may add significant cost, may require input by a user to a control system, and/or may not react relatively quickly to user input.

Pivoting foot pedal systems have been disclosed in previous patents (e.g., U.S. Pat. No. 5,690,589 to Rodgers, Jr.). Pivoting foot pedal systems may be configured such that the pivotal connection to the pedal is located above the pedal surface and a pendulum action may occur during pedal pivoting. This pendulum action may slightly increase the stride length. Such increases in stride length, however, are generally a small percentage of stride length and are not generally perceived by a user of the apparatus.

U.S. Pat. No. 6,689,019 to Ohrt et al., which is incorporated by reference as if fully set forth herein, discloses a user defined, dynamically variable stride exercise apparatus. A crank based system with a link that engages a roller at the end of a crank is disclosed. The link may have springs or cams to control and limit stride length. The cams, however, are placed away from the user. The resultant forces created by the cam are limited because the full weight of the user may not be applied to the cam. A housing to cover the crank and cam system may be large, thus adding to manufacturing cost. In addition, the overall length of the system may be relatively high.

SUMMARY

In an embodiment, a variable stride exercise apparatus may include a frame. A crank system may be coupled to the frame. The crank system may include a left crank roller and a right crank roller. In certain embodiments, a left arm link and a right arm link may be coupled to the frame. In certain embodiments, the apparatus may include a braking device coupled to the crank system.

The apparatus may include a left foot member. The left foot member may be coupled to a left arm link. The left foot member may travel in multiple paths. The left foot member may be coupled to a crank system through a left cam device. The left crank roller of the crank system may be located below the left foot member such that at least a portion of a user's foot passes above the crank roller during use of the apparatus. A user of the apparatus, by varying the user's stride, may selectively vary a path of the left foot member.

The apparatus may include a right foot member. The right foot member may be coupled to a right arm link. The right foot member may travel in multiple paths. The right foot member may be coupled to a crank system through a right cam device. The right crank roller of the crank system may be located below the right foot member such that at least a portion of a user's foot passes above the crank roller during use of the apparatus. A user of the apparatus, by varying the user's stride, may selectively vary a path of the right foot member.

The left foot member and the right foot member may be cross coupled so that the left foot member moves in opposition to the right foot member. The feet of a user of the apparatus may travel in a substantially closed path during use of the apparatus. In some embodiments, at least a portion of the apparatus may remain substantially stationary during use.

BRIEF DESCRIPTION OF THE DRAWINGS

Advantages of the present invention may become apparent to those skilled in the art with the benefit of the following detailed description and upon reference to the accompanying drawings in which.

Figure 1A:
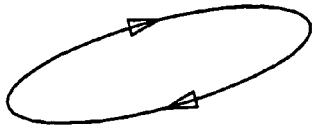
FIGS. 1A, 1B, 1D, 1E, and 1F depict embodiments of closed paths.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION

In the context of this patent, the term "coupled" means either a direct connection or an indirect connection (e.g., one or more intervening connections) between one or more objects or components. The phrase "directly attached" means a direct connection between objects or components.

Figure 1B:
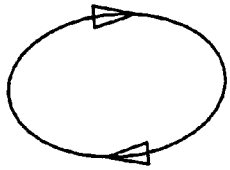
Figure 1C:
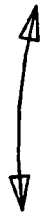
FIG. 1C depicts an embodiment of a curvilinear path.
Figure 1D:
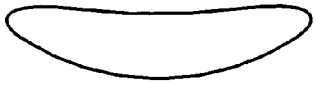
Figure 1E:
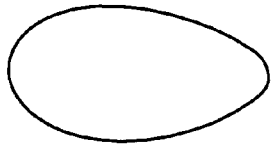
Figure 1F:
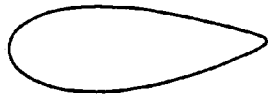

Aerobic exercise apparatus may be designed to create a variable path (e.g., a closed path or a reciprocating path) in space for limb engaging devices. For example, an exercise apparatus may create an approximately elliptical or approximately circular closed path in space (e.g., as shown in FIGS. 1A and 1B) for foot pedals or footpads to simulate a climbing, walking, striding, or jogging motion. In some embodiments, an exercise apparatus may create an approximately curvilinear path in space (e.g., as shown in FIG. 1C) for foot pedals or footpads to simulate a stepping or climbing motion. Footpads may move in a repetitive manner along a closed path. A closed path may be defined as a path in which an object (e.g., a user's foot, footpad, or foot member) travels in a regular or irregular path around a point or an area. The shape of a closed path may depend on the generating linkage mechanism. For example, a closed path may be an elliptical path, a saddle-shaped path, an asymmetrical path (e.g., a closed path with a smaller radius of curvature on one side of the path as compared to the other side), or an ovate or egg-shaped path. Examples of closed paths are shown in FIGS. 1A, 1B, 1D, 1E, and 1F. In some embodiments, a closed path may be elliptical, orbital, or oblong. In certain embodiments, footpads may move in a repetitive manner along a curvilinear path or an arcuate path.

Exercise apparatus that create a defined path in space may have certain advantages. Certain advantages may include, but are not limited to, the reduction or elimination of impact on a user, an integrated inertia system that automatically causes directional change of the footpads, and/or a rapid learning curve for the user. These machines may, however, limit the range of motion of the user. An exercise apparatus that provides a user with a variable range of motion may advantageously provide compactness, controllable foot articulation patterns, and/or better variable stride control suitable for a greater variety of users.

In certain embodiments, certain types of systems may be used to provide a variable range of motion on an exercise apparatus. A "variable stride system" may be used to provide a variable range of motion on an exercise apparatus so that a user's stride length is variable during use of the apparatus. Variable stride systems may include cam type resistive/restoring devices and/or spring/damper type resistive/restoring devices. One or more portions of a variable stride system may be coupled to or incorporated as part of an exercise apparatus.

Figure 2A:
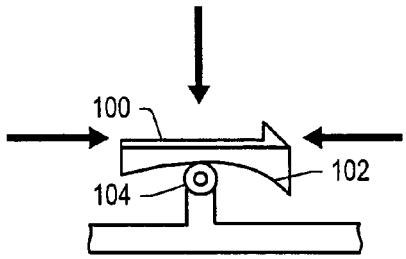
FIGS. 2A, 2B, 2C, and 2D depict embodiments of cam type resistive/restoring devices that may provide a variable range of motion in a closed path.

FIGS. 2A-2D depict embodiments of cam type resistive/restoring devices that may provide a variable range of motion in a closed path. In FIG. 2A, foot member 100 with cam device 102 engages roller 104. Foot member 100 may translate forward and rearward as surface of cam device 102 moves along roller 104. As a user steps on foot member 100, forces may be created by the interaction of the cam device surface and roller 104 such that the foot member is either accelerated or decelerated. In some embodiments, a slider may be used instead of roller 104 depicted in FIG. 2A. A slider may produce frictional drag forces, which in some cases may induce desirable damping forces.

Figure 2B:
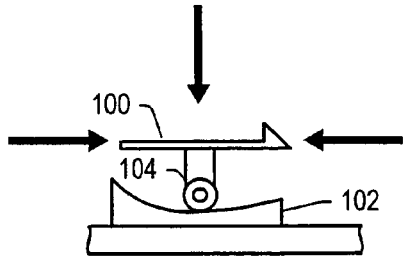
Figure 2C:
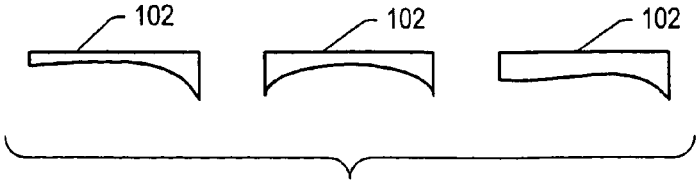
Figure 2D:
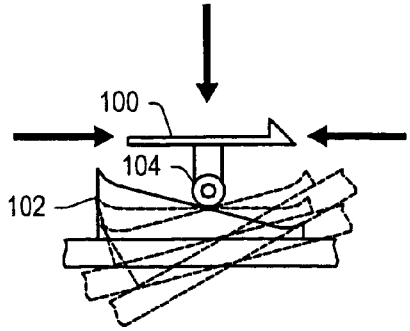

In FIG. 2B, the relationship between the cam device and roller is inverted. Roller 104 is directly attached to foot member 100. Cam device 102 is separate from foot member 100 and engages roller 104. FIG. 2C depicts a variety of surface shapes that may be used for cam device 102. The surface of cam device 102 may take on a variety of shapes depending on the objectives of a designer of an exercise apparatus. Certain profiles for cam device 102 may generate more or less restoring force. Cam device rotation during use of an exercise apparatus may affect the choice of the cam device surface shape by a designer. Portions of the cam device surface may be concave relative to the roller. In some embodiments, portions of the cam device surface may be convex relative to the roller. In some embodiments, portions of the cam device surface may also be straight and still generate restoring forces in certain configurations, as shown in FIG. 2D. The orientation of a cam device may change as a linkage system operates. For example, there may be rotation in space relative to a fixed reference plane such as the floor. In certain embodiments, this cam device rotation in space may be referred to as "cam device rotation". Cam device rotation during use of an exercise apparatus may cause the cam device surface to tilt relative to a roller. Restoring forces may be generated by this relative tilt to generate a desired performance of the exercise apparatus.

Figure 3:
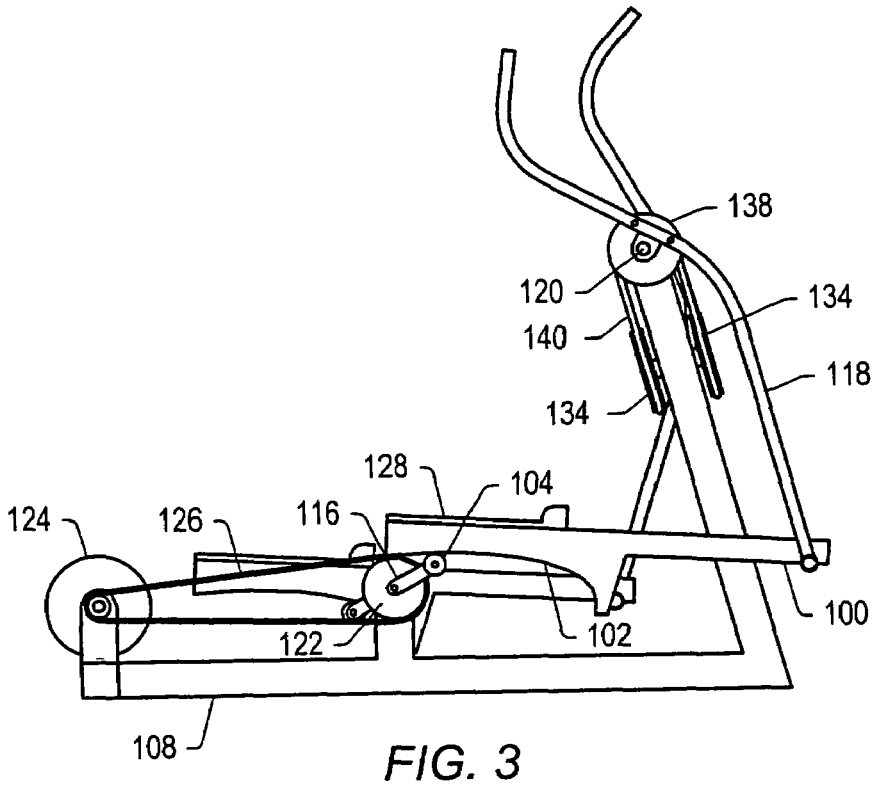
FIG. 3 depicts a side view of an embodiment of an exercise apparatus.

FIG. 3 depicts a side view of an embodiment of an exercise apparatus. Frame 108 may include a basic supporting framework and an upper stalk. Frame 108 may be any structure that provides support for one or more components of an exercise apparatus. In certain embodiments, all or a portion of frame 108 may remain substantially stationary during use. For example, all or a portion of frame 108 may remain substantially stationary relative to a floor on which the exercise apparatus is used. "Stationary" generally means that an object (or a portion of the object) has little or no movement during use.

Crank members 116 may be coupled to a crankshaft and pulley device 122. Crank members 116, the crankshaft, and pulley device 122 may be supported by frame 108. Crank members 116 may drive pulley device 122, which in turn may drive brake/inertia device 124 using belt 126. A "crank system" may include, in a generic case, crank member 116 coupled (either directly attached or indirectly attached) to pulley device 122. In some embodiments, a crank system may include rollers (e.g., rollers 104) coupled to crank members 116. In some embodiments, a crank system may be formed from other types of devices that generally convert reciprocation or motion of a member to rotation. For example, a crank system may include a ring (e.g., a metal ring) supported by one or more rollers. In certain embodiments, a crank system may include one or more intermediate components between the crank member and the pulley (e.g., an axle or connectors). In certain embodiments, a crank system may be directly attached to frame 108. In some embodiments, a crank system may be indirectly coupled to frame 108 with one or more components coupling the crank system to the frame.

Crank member 116 may be coupled to roller 104. Roller 104 may engage cam device 102. Cam device 102 may be coupled (e.g., mounted) to foot member 100 or may be a part of the foot member. In certain embodiments, foot member 100 may be a pivotal foot member. Foot member 100 may be pivotally coupled at one end to arm link 118. Arm links 118 may be pivotally coupled to and supported by frame 108 at point 120.

In certain embodiments, left and right foot members 100 may move in a back and forth motion (i.e., one member moves forward as the other member moves backward in a reciprocating motion). In some embodiments, foot members 100 may be foot members that move in a closed path (e.g., a circular path, an elliptical path, or an asymmetrical path).

Arm links 118 may be pivotally coupled to foot members 100. In certain embodiments, arm links 118 may be directly attached (e.g., pivotally and directly attached) to foot members 100. Arm links 118 may be designed so that the upper portions can be used as grasping members (e.g., handles). A "pivotal linkage assembly" is generally an assembly that includes two or more moving links that are pivotally coupled to each other. In certain embodiments, a pivotal linkage assembly includes foot member 100 and arm link 118. In some embodiments, a pivotal linkage assembly may include one or more other components such as links, connectors, and/or additional members that couple to and/or provide coupling between foot member 100 and arm link 118.

In certain embodiments, right and left side linkage systems (e.g., foot members 100 and/or arm links 118) may be cross coupled so that they move in direct and constant opposition to one another. In some embodiments, linkage systems may be mechanically cross coupled (e.g., as shown in the embodiment depicted in FIGS. 5 and 6). In some embodiments, linkage systems may be cross coupled using a pulley and belt system. Link pulleys 138 may be rigidly coupled to and rotate in unison with arm links 118. Idler pulleys 134 may be mounted to frame 108 and may rotate freely. Coupling belt 140 may be a continuous loop that wraps around link pulleys 138, both right and left sides, and idler pulleys 134, both upper and lower. Coupling belt 140 may be coupled to link pulleys 138 such that there is limited or no slip in the coupling belt. The coupling can be made by commonly available fasteners, or the belt and pulley may be cogged. In some embodiments, sections of roller chain engaging sprockets, rather than pulleys, may be used. The belt and pulley system, which includes link pulleys 138, idler pulleys 134, and/or coupling belt 140, may serve to cross couple the right side and left side linkage systems so that forward motion of the right side linkage system causes rearward motion of the left side linkage system, and vice versa.

Foot member 100 may have footpads 128 or any other surface on which a user may stand. Footpad 128 is typically any surface or location on which a user's foot resides during use of an exercise apparatus (e.g., the footpad may be a pad or a pedal on which the user's foot resides during use). In some embodiments, footpad 128 may be a portion of foot member 100.

The forward portion of foot member 100 is shown to be straight in FIG. 3. Foot member 100 may, however, be curved and/or include a bend. In certain embodiments, foot member 100 is made of a solid or unitary construction. In some embodiments, foot member 100 may include multiple components (e.g., cam device 102) coupled or fastened to achieve a desired performance. Similarly, arm links 118 may be straight, bent, or curved. Arm links 118 may be unitary or may include multiple components.

In an embodiment, a user ascends the exercise apparatus, stands on footpads 128 and initiates a walking, striding, or jogging motion. Roller 104 may be located below foot member 100 such that a user's foot passes above the roller during use of the apparatus. The weight of the user on footpad 128 may cause a force to be transmitted through cam device 102 and roller 104. This force in turn may cause the rotation of crank members 116, pulley device 122, and/or brake/inertia device 124. As crank members 116 rotate, foot members 100 may undertake a motion that approximates a closed path near pulley device 122. In an embodiment, foot member 100 interacts with crank member 116 through roller 104. Foot members 100 and cam devices 102 may translate relative to crank members 116. The interaction of foot member 100 with crank member 116 at cam device 102 (or any other variable stride system) may result in a changing or dynamic angular relationship. The nature of the interaction and the magnitude and direction of the forces transmitted through roller 104 may be controlled by the shape and/or orientation of cam device 102.

The interaction between roller 104 and cam device 102 may allow relative horizontal displacement of footpads 128 with a restoring force. As the user variably applies force on footpads 128, force may be transmitted through rollers 104 to crank members 116. In certain embodiments, as crank members 116 rotate, the crank members may impart force to foot members 100 through roller 104 and cam device 102, particularly at the end or beginning of a step or stride by the user. These forces may assist in changing direction of foot member 100 at the end or beginning of a step. In certain embodiments, these forces may assist in returning a user's foot to a neutral position during use. In an embodiment, the user determines and selects the actual stride length as foot members 100 are not pivotally coupled to crank members and the foot members are allowed to translate relative to the crank members. The user may essentially be allowed to "instantaneously" or "dynamically" change his/her stride length by imparting variable forces to foot members 100. The user may selectively impart forces (e.g., at a beginning or an end of a stride) that vary the path (e.g., the path length or the shape of the path) of foot members 100. Thus, the user may vary his/her stride so that the path of foot members 100 is varied. In certain embodiments, cam device 102 may assist in imparting forces that change the direction of foot members 100.

Figure 4:
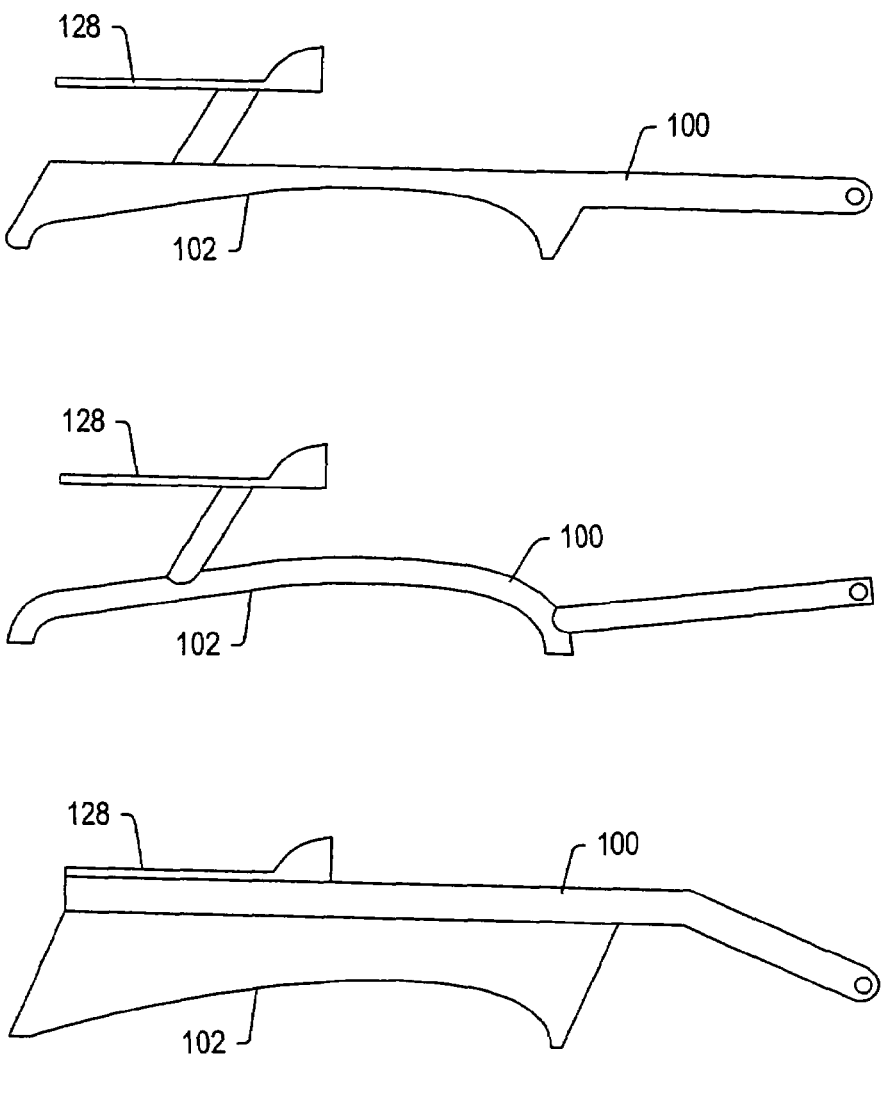
FIG. 4 depicts embodiments of foot members and cam devices for an exercise apparatus.

Cam device 102 may be formed to a specific shape to provide desired operating characteristics. In some embodiments, cam device 102 may be included as a part of foot member 100. Examples of different embodiments of cam device 102 and foot member 100 are depicted in FIG. 4. In certain embodiments, cam device 102 and roller 104, or any other variable stride system, may be located within about 24 inches (e.g., about 18 inches or about 12 inches) of an end of footpad 128. In certain embodiments, at least a portion of a variable stride system (e.g., a cam device) may be located under (e.g., directly under) at least a portion of footpad 128.

Figure 6:
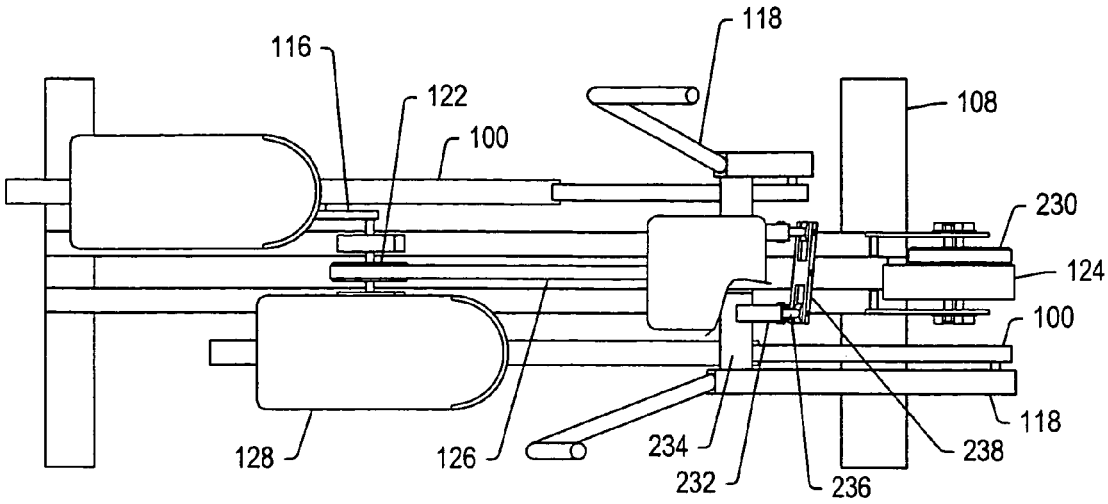
FIG. 6 depicts a top view of an embodiment of an exercise apparatus.
Figure 5:
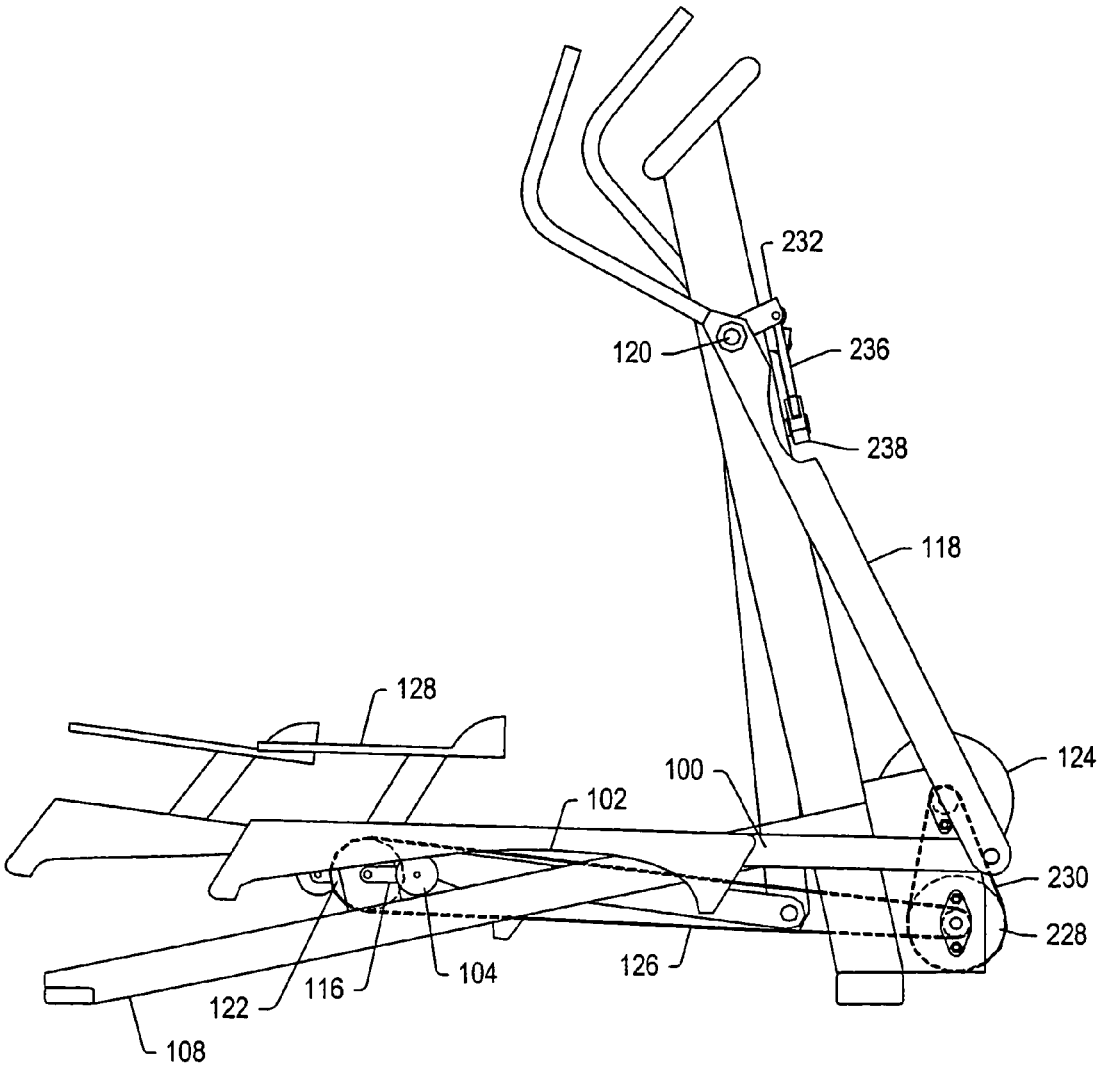
FIG. 5 depicts a side view of an embodiment of an exercise apparatus.

In some embodiments, brake/inertia device 124 may be located ahead of a user or behind a user. A "brake/inertia device" may provide a load to affect the intensity of a cardiovascular workout. A brake/inertia device may include an energy-storing member (e.g., flywheel) that is coupled to a linkage or crank system to increase inertia of the system. In some embodiments, a brake/inertia device may provide for a variable load. FIG. 5 depicts a side view of an embodiment of an exercise apparatus. FIG. 6 depicts a top view of the embodiment depicted in FIG. 5. Frame 108 may include a basic supporting framework and an upper stalk. Crank members 116 may be coupled to a crankshaft and pulley device 122. Crank members 116, the crankshaft, and pulley device 122 may be supported by frame 108. Brake/inertia device 124 may be located at a forward portion of frame 108 (e.g., ahead of a user). Pulley device 122 may drive brake/inertia device 124 through belt 126, sheave 228, and belt 230. In an embodiment, belt 126 engages a small diameter portion of sheave 228. A large diameter portion of sheave 228 may engage belt 230. Belt 230 may engage brake/inertia device 124.

Crank member 116 may have roller 104 that engages cam device 102. In certain embodiments, cam device 102 may be coupled (e.g., mounted) to foot member 100. In some embodiments, cam device 102 may be a part of the foot member. Examples of different embodiments of cam device 102 and foot member 100 are depicted in FIG. 4. Different embodiments of cam device 102 and foot member 100 may achieve similarly desired functions. Foot members 100 may have footpads 128 on which a user may stand.

In certain embodiments, foot member 100 may be a pivotal foot member. As shown in FIG. 5, foot member 100 may be pivotally coupled at one end to arm link 118. Arm links 118 may be designed such that the upper portions can be used as grasping members. Arm links 118 may be pivotally coupled to and supported by frame 108 at point 120. In some embodiments, arm links 118 may be cross coupled as previously described in the embodiment depicted in FIG. 3.

In certain embodiments, arm links 118 may be mechanically cross coupled, as shown in FIGS. 5 and 6. Elements 232 may be coupled (e.g., rigidly attached) to arm links 118 through tubes 234. Thus, each element 232 (right or left) may move in unison with each arm link 118 (right or left). Connectors 236 may couple elements 232 (both right and left) to rocker arm 238. Connectors 236 may be connector rods. Rocker arm 238 may be pivotally coupled to an upper portion of frame 108. In an embodiment, as arm links 118 move, connectors 236 may cause rocking motion of rocker arm 238. This rocking motion causes right and left arm links 118 to move in opposition (i.e., the right and left arm links are cross coupled).

Figure 7:
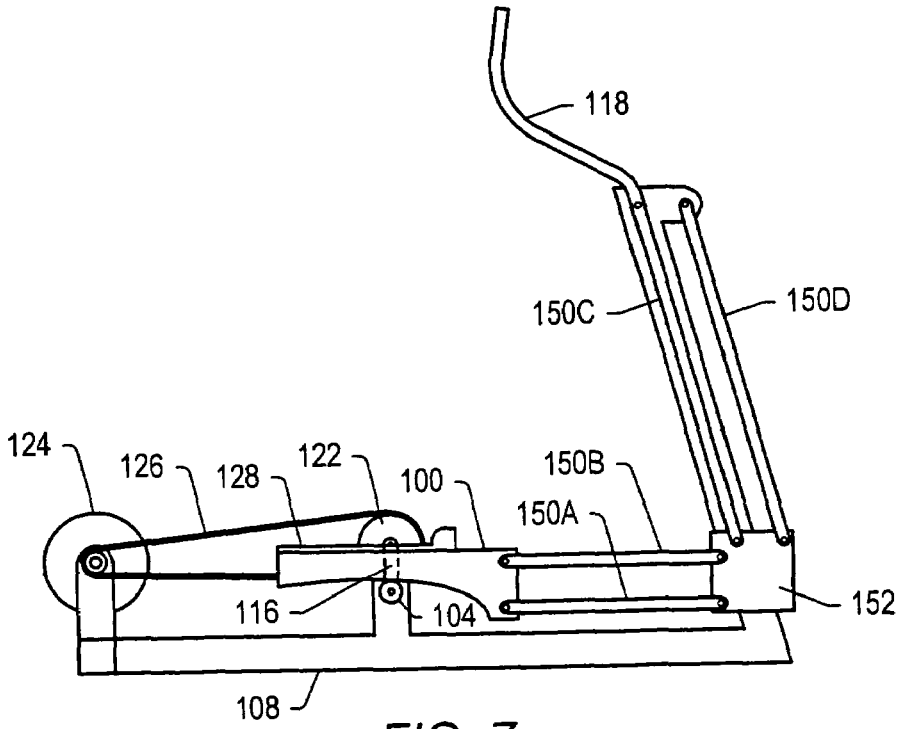
FIG. 7 depicts a schematic of an embodiment of an exercise apparatus.

FIG. 7 depicts a schematic of an embodiment of an exercise apparatus. The embodiment of FIG. 7 includes several features of the embodiment depicted in FIG. 3. FIG. 7 shows a system that utilizes a multilink connection to foot member 100 to control the orientation and rotation of the foot member. Links 150A, 150B, 150C, and 150D may work in unison with connector plate 152 to maintain foot member 100 substantially parallel to the floor during use. In some embodiments, a designer may alter the geometry of the linkage system by adjusting the lengths of links 150A, 150B, 150C, and 150D and/or the position of the connection points to induce a desired rotation pattern for foot member 100.

Cam device 102 may have a long length cam surface compared to the length of crank member 116. In certain embodiments, cam device 102 may have a cam surface with a length that exceeds a crank diameter of the crank system. The crank radius of the crank system is generally the length of one crank member 116. Thus, the crank diameter is twice the length of one crank member 116. In some embodiments, the length of the cam surface of cam device 102 is at least about 1.5 times the crank diameter of the crank system. In some embodiments, the length of the cam surface of cam device 102 is at least about 2 times the crank diameter of the crank system. The length of the cam surface of cam device 102 is the path length along the cam surface (e.g., the length along a curved surface of the cam device). The long length of the cam surface compared to the crank diameter of the crank system may provide a long stride length on a relatively compact exercise apparatus.

The embodiments depicted in FIGS. 3, 5, 6, and 7 may provide several advantages. For example, a user's stride length may not be constrained by dimensions of components of the crank system. Cam device 102 may allow a user to select a longer or shorter stride. A user may select a longer or shorter stride based on his/her own stride length. For example, in certain exercise apparatus, a stride length between about 0 inches and about 30 inches may be selected.

In certain embodiments, a maximum stride length of an apparatus may be between about 35% and about 50% of an overall length of the apparatus. In certain embodiments, a maximum stride length of an apparatus may be at least about 40% of an overall length of the apparatus. Having a larger maximum stride length to overall length ratio allows an exercise apparatus to be more compact while maintaining a relatively larger user controlled variation in stride length. Designing and producing such an exercise apparatus tends to reduce costs (e.g., materials or construction costs) for building the exercise apparatus.

In certain embodiments, the exercise apparatus may assist in direction changes of foot members 100 at the end of a stride. In certain embodiments, cam device 102 is located (e.g., near a user's foot) such that a force equal to or greater than about 50% of the body weight of the user is applied through the cam device and roller 104 to the exercise apparatus. In some embodiments, nearly full body weight of the user is applied through cam device 102 and roller 104 to the exercise apparatus. This application of a large percentage of body weight may provide a designer the opportunity to create large or significant restoring forces in the exercise apparatus. These significant restoring forces may be advantageous, particularly at the end of a stride when foot members 100 and the linkage assembly must be decelerated and reaccelerated by cam device 102 to accomplish the desired direction change. These large restoring forces may provide assistance in direction change of the user's feet and may provide a more comfortable and natural exercise pattern for the user.

In certain embodiments, cam device 102 is located away from a brake/inertia system. A housing used to enclose the brake/inertia system may be of normal and reasonable size because of the location of the brake/inertia system away from cam device 102. Thus, a housing may be more reasonable in size since the housing only includes the brake/inertia system and does not enclose cam device 102 or other components that may increase the size of the housing. Using a smaller housing to enclose the brake/inertia system may significantly save in costs for materials and construction of an exercise apparatus. These savings may be reflected in a selling price charged for an exercise apparatus.

In certain embodiments, a shorter overall length of frame 108, and thus the exercise apparatus, is achieved with a pivotal linkage assembly (e.g., foot members 100 and arm links 118) interacting with crank members 116 through cam device 102. Reducing the overall length of frame 108 may improve the commercial applicability of an exercise apparatus. Larger exercise apparatus may be significantly more expensive to produce and thus have a price that may significantly limit a commercial market for the larger exercise apparatus. Reducing the size of an exercise apparatus may reduce costs (e.g., materials or construction costs) for building the exercise apparatus and allow a lower selling price for the smaller exercise apparatus than a larger exercise apparatus, thus expanding the market for the smaller exercise apparatus.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An exercise apparatus, comprising:

a stationary frame;

a crank system coupled to the frame;

a left arm link coupled to the frame;

a left multi-link assembly having at least two links, one end of the left multi-link assembly pivotally coupled to the left arm link distal the coupling of the left arm link to the frame;

a right arm link coupled to the frame;

a right multi-link assembly having at least two links, one end of the right multi-link assembly pivotally coupled to the right arm link distal the coupling of the right arm link to the frame;

a left foot member directly attached to a left cam device, wherein the left foot member is configured to travel in multiple paths, wherein the left foot member is pivotally coupled to the left multi-link assembly and coupled to the crank system through the left cam device, and wherein the left foot member, left multi-link assembly and left arm link are configured such that the user of the apparatus, by varying the user's stride, can thereby selectively vary a path of the left foot member; and a right foot member directly attached to a right cam device, wherein the right foot member is configured to travel in multiple paths, wherein the right foot member is pivotally coupled to the right multi-link assembly and coupled to the crank system through the right cam device, and wherein the right foot member, right multi-link assembly and right arm link are configured such that the user of the apparatus, by varying the user's stride, can thereby selectively vary a path of the right foot member;

wherein the apparatus is configured such that the feet of the user can travel in a substantially closed path during use of the apparatus.

2. The apparatus of claim 1, wherein the substantially closed path comprises a substantially elliptical path.

3. The apparatus of claim 1, wherein the substantially closed path comprises an orbital path.

4. The apparatus of claim 1, wherein the apparatus is configured such that the feet of the user can also travel in a substantially curvilinear path during use of the apparatus.

5. The apparatus of claim 1, wherein the foot members and the arm links are configured such that the user's stride controls the path of the foot members.

6. The apparatus of claim 1, wherein the foot members, multi-link assemblies and arm links are configured such that the user of the apparatus, by varying the user's stride, can thereby selectively vary a path length of the foot members.

7. The apparatus of claim 1, wherein the arm links are pivotally coupled to the frame.

8. The apparatus of claim 1, wherein the crank system comprises a left crank roller and a right crank roller and the foot members are coupled to the crank system through the cam devices, and wherein a surface of at least one of the cam devices is configured to move relative to at least one of the crank rollers during use.

9. The apparatus of claim 1, wherein at least one of the cam devices comprises a portion of at least one foot member.

10. The apparatus of claim 1, wherein the cam devices are directly attached to the foot members.

11. The apparatus of claim 1, further comprising a left footpad coupled to the left foot member and a right footpad coupled to the right foot member.

12. The apparatus of claim 1, wherein the left foot member comprises a left footpad, and wherein the right foot member comprises a right footpad.

13. The apparatus of claim 1, wherein the crank system comprises a pulley.

14. The apparatus of claim 13, wherein the crank system comprises a left crank member and a right crank member coupled to the pulley and a left crank roller and a right crank roller, and wherein the left crank member is coupled to the left crank roller and the right crank member is coupled to the right crank roller.

15. The apparatus of claim 1, wherein the apparatus further comprises a brake/inertia device is coupled to a portion of the frame behind the user.

16. The apparatus of claim 1, wherein the foot members, multi-link assemblies, arm links, and cam devices are configured to allow the user of the apparatus to selectively vary the path of the foot members based on an amount of force applied by the user's feet during use of the apparatus.

17. The apparatus of claim 1, wherein the foot members, multi-link assemblies, arm links, and the cam devices are configured to provide a force that restores the user's feet to a neutral position during use of the apparatus.

18. The apparatus of claim 1, wherein the foot members, multi-link assemblies, arm links, and cam devices are configured such that a force from a majority of the weight of the user is applied to the cam devices.

19. The apparatus of claim 1, wherein the crank system is directly attached to the frame.

20. The apparatus of claim 1, wherein the apparatus has a maximum stride length that is at least about 40% of an overall length of the apparatus while stationary.

21. An exercise apparatus, comprising:

a stationary frame;

a crank system coupled to the frame wherein the crank system comprises a left crank roller and a right crank roller;

a left arm link coupled to the frame;

a left multi-link assembly having at least two links, one end of the multi-link assembly pivotally coupled to the left arm link distal the coupling of the left arm link to the frame;

a right arm link coupled to the frame;

a right multi-link assembly having at least two links, one end of the right multi-link assembly pivotally coupled to the right arm link distal the coupling of the right arm link to the frame;

a left foot member directly attached to a left cam device, wherein the left foot member is configured to travel in multiple paths, wherein the left foot member is pivotally coupled to the left multi-link assembly and coupled to the crank system through the left cam device, wherein the left crank roller is located below the left foot member such that at least a portion of a user's foot passes above the crank roller during use of the apparatus, and wherein the left foot member, left multi-link assembly and left arm link are configured such that the user of the apparatus, by varying the user's stride, can thereby selectively vary a path of the left foot member; and a right foot member directly attached to a right cam device, wherein the right foot member is configured to travel in multiple paths, wherein the right foot member is pivotally coupled to the right multi-link assembly and coupled to the crank system through the right cam device, wherein the right crank roller is located below the right foot member such that at least a portion of the user's foot passes above the crank roller during use of the apparatus, and wherein the right foot member, right multi-link assembly and right arm link are configured such that the user of the apparatus, by varying the user's stride, can thereby selectively vary a path of the right foot member, wherein the apparatus is configured such that the feet of the user can travel in a substantially closed path during use of the apparatus.

* * * * *